US008298740B2

(12) United States Patent
Kim et al.

(10) Patent No.: US 8,298,740 B2
(45) Date of Patent: Oct. 30, 2012

(54) TONER FOR DEVELOPING ELECTROSTATIC LATENT IMAGE AND METHOD OF PREPARING THE SAME

(75) Inventors: Jae-Hwan Kim, Seoul (KR); Jun-Young Lee, Seoul (KR); Yo-Da Shin, Incheon (KR); Tae-Hoe Koo, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 393 days.

(21) Appl. No.: 12/572,841

(22) Filed: Oct. 2, 2009

(65) Prior Publication Data

US 2010/0151372 A1 Jun. 17, 2010

(30) Foreign Application Priority Data

Dec. 17, 2008 (KR) ..... 10-2008-0128620

(51) Int. Cl.
*G03G 9/00* (2006.01)

(52) U.S. Cl. ..... 430/110.3; 430/107.1; 430/108.24; 430/108.8

(58) Field of Classification Search ..... 430/110.3, 430/107.1, 108.24, 108.8
See application file for complete search history.

(56) References Cited

U.S. PATENT DOCUMENTS

| | | | | |
|---|---|---|---|---|
| 5,707,771 | A | 1/1998 | Matsunaga | |
| 5,851,714 | A | 12/1998 | Taya et al. | |
| 6,203,959 | B1 | 3/2001 | Tanikawa et al. | |
| 6,946,228 | B2 | 9/2005 | Kanamaru et al. | |
| 8,080,359 | B2 | 12/2011 | Matsubara et al. | |
| 2006/0063087 | A1 | 3/2006 | Ninomiya et al. | |
| 2006/0210904 | A1 | 9/2006 | Ninomiya et al. | |
| 2006/0283806 | A1 * | 12/2006 | Kojima et al. | 210/725 |
| 2007/0087281 | A1 * | 4/2007 | Patel et al. | 430/110.2 |
| 2008/0026313 | A1 | 1/2008 | Sugahara et al. | |
| 2009/0111038 | A1 * | 4/2009 | Shin et al. | 430/48 |

FOREIGN PATENT DOCUMENTS

| | | |
|---|---|---|
| JP | 62-070859 | 4/1987 |
| JP | 8234480 | 9/1996 |
| JP | 9325520 | 12/1997 |
| JP | 2000275908 | 10/2000 |
| JP | 2000321815 | 11/2000 |
| JP | 2005173566 | 6/2005 |
| JP | 2008191652 | 8/2008 |
| KR | 20060050908 | 5/2006 |
| KR | 20060101176 | 9/2006 |

* cited by examiner

*Primary Examiner* — Thorl Chea

(74) *Attorney, Agent, or Firm* — Stanzione & Kim, LLP

(57) ABSTRACT

Provided are toner for developing an electrostatic latent image and a method of preparing the same. The toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa. The G'(60) and G'(80) are storage moduli Pa at about 60° C. and about 80° C. under measurement conditions of an angular velocity of about 6.28 rad/s and a heating rate of about 2.0° C./minute, respectively. The G'(100, 140) is a storage modulus Pa at a temperature of about 100° C. to about 140° C. under measurement conditions of an angular velocity of about 6.28 rad/s and a heating rate of about 2.0° C./minute.

8 Claims, 2 Drawing Sheets

TONER FOR DEVELOPING ELECTROSTATIC LATENT IMAGE AND METHOD OF PREPARING THE SAME

CROSS-REFERENCE TO RELATED PATENT APPLICATION

This application claims the benefit of Korean Patent Application No. 10-2008-0128620, filed on Dec. 17, 2008, in the Korean Intellectual Property Office, the disclosure of which is incorporated herein in its entirety by reference.

TECHNICAL FIELD

The disclosure relates to toner for developing an electrostatic latent image and a method of preparing the same.

BACKGROUND OF THE RELATED ART

In electrophotographic processes or electrostatic recording process, developers which visualize electrostatic images or electrostatic latent images are classified into two-component developers formed of toner and carrier particles and one-component developers which are substantially formed of only toner, that is, which do not use carrier particles. The one-component developers may be classified into magnetic one-component developers which contain a magnetic component, and nonmagnetic one-component developers which do not contain a magnetic component. Fluiding agents such as colloidal silica, may be often independently added to nonmagnetic one-component developers to improve the fluidity of toner. In general, coloring particles obtained by dispersing a colorant such as carbon black or other additives in a latex are used as the toner.

Toners may be prepared using a pulverizing method or a polymerizing method. In the pulverizing method, a synthesized resin, a colorant, and when required, other additives are melted, pulverized, and then sorted to obtain particles having desirable diameters, to thereby obtain the toner. In the polymerizing method, a colorant, a polymerization initiator, and when required, other additives such as a crosslinking agent or an antistatic agent, are uniformly dissolved in or dispersed into a polymerizable monomer to prepare a polymerizable monomer composition. Then, the polymerizable monomer composition is dispersed into an aqueous dispersion medium, including a dispersion stabilizer, using a stirrer to form micro droplet particles of the polymerizable monomer composition. Subsequently, the temperature is increased and then a suspension polymerization process is performed to obtain colored polymerization particles having desirable diameters, that is, a polymerization toner.

In image forming apparatuses such as electrophotographic apparatuses or electrostatic recording apparatuses, an image is formed by exposing an image on a uniformly charged photoreceptor to form an electrostatic latent image; attaching toner to the electrostatic latent image to transfer the toner image onto a transfer medium such as a transfer paper or the like; and then fusing the toner image on the transfer medium using any of a variety of methods including heating, pressurizing, applying a solvent vapor, and the like. In most fusing processes, the transfer medium with the toner image passes through fusing rollers and pressing rollers, and the toner is heated and pressed to fuse the toner image to the transfer medium.

Images formed by an image forming apparatus such as an electrophotocopier should satisfy the requirements of high precision and accuracy. Conventionally, toner used in an image forming apparatus is usually obtained using a pulverizing method. According to the pulverizing method, coloring particles having a large range of sizes are formed. Thus, to obtain satisfactory developing properties, there is a need to sort the coloring particles obtained through pulverization according to size so as to reduce the particle size distribution of toner. However, it is difficult to precisely control the particle size and the particle size distribution of the toner using a conventional mixing/pulverizing process in the manufacture of toner suitable for an electrophotographic process or an electrostatic recording process. Also, when preparing a fine-particle toner, the toner preparation yield is adversely affected by the sorting process. In addition, there are limits to the change/adjustment of toner design for obtaining desirable charging and fusing properties. Accordingly, a polymerized toner, the size of particles of which is easy to control and which do not need to undergo a complex manufacturing process such as sorting, has been highlighted recently.

When toner is prepared using a polymerizing method, a polymerized toner having a desired particle size and particle size distribution may be obtained without pulverizing or sorting.

However, although such a polymerized toner can be used to secure adequate printing performance and image quality when printing, functional properties such as fusibility and durability of the toner need be also considered. Thus, it is desirable to develop toner having optimized rheological properties.

SUMMARY OF THE DISCLOSURE

The disclosure provides toner, which may realize a superior quality image with high gloss and have a wide fusing region.

According to an aspect of the disclosure, there is provided a toner for developing an electrostatic latent image and including a latex, a colorant, and a releasing agent, wherein the toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, the G'(60) and G'(80) are storage moduli Pa at about 60° C. and about 80° C. under measurement conditions of an angular velocity of about 6.28 rad/s and a heating rate of about 2.0° C./minute, respectively, and the G'(100, 140) is a storage modulus Pa at a temperature of about 100° C. to about 140° C. under measurement conditions of an angular velocity of about 6.28 rad/s and a heating rate of about 2.0° C./minute.

The toner may further include sulfur (S), iron (Fe), and silicon (Si), and when S content, Fe content, and Si content according to a fluorescence X-ray analysis are referred to as [S], [Fe], and [Si], respectively, a ratio of [S]/[Fe] is in the range of about $5.0\times10^4$ to about $5.0\times10^{-2}$, and a ratio of [Si]/[Fe] is in the range of about $5.0\times10^{-4}$ to about $5.0\times10^{-2}$.

A peak temperature of a maximal endothermic peak curve may be in the range of about 86° C. to about 95° C. on a differential scanning calorimeter (DSC) endothermic curve of the toner measured using a DSC.

The toner may further include silicon (Si) and iron (Fe), each having the range of about 3 ppm to about 30,000 ppm.

The releasing agent may include, but is not limited to a mixture of a paraffin-based wax and an ester-based wax; or an ester group-containing paraffin-based wax.

The content of the ester-based wax of the releasing agent may be in the range of about 5% by weight to about 39% by weight based on the total weight of the releasing agent.

A volume average particle diameter of the toner may be in the range of about 3 μm to about 8 μm.

An average value of circularity of the toner is in the range of about 0.940 to about 0.990.

Values of a volume average particle size distribution index (GSDv) and a number average particle size distribution index (GSDp) of the toner may be about 1.30 or less, respectively.

According to another aspect of the disclosure, there is provided a method of preparing a toner for developing an electrostatic latent image, the method including: mixing a primary latex particle, a colorant dispersion, and a releasing agent dispersion to prepare a mixture thereof; adding a coagulant to the mixture to prepare a primary agglomerated toner; and coating a secondary latex prepared by polymerizing one or more polymerizable monomers on the primary agglomerated toner to prepare a secondary agglomerated toner, wherein the toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, the G'(60) and G'(80) are storage moduli Pa at about 60° C. and about 80° C. under measurement conditions of an angular velocity of about 6.28 rad/s and a heating rate of about 2.0° C./minute, respectively, and the G'(100, 140) is a storage modulus Pa at a temperature of about 100° C. to about 140° C. under measurement conditions of an angular velocity of about 6.28 rad/s and a heating rate of about 2.0° C./minute.

The primary latex particle may include, but is not limited to a polyester alone; a polymer obtained by polymerizing one or more polymerizable monomers; or a mixture thereof.

The method may further include coating a tertiary latex prepared by polymerizing one or more polymerizable monomers on the secondary agglomerated toner.

The polymerizable monomer may include, but is not limited to at least one monomer selected from styrene-based monomers; acrylic acid or methacrylic acid; derivatives of (metha)acrylates; ethylenically unsaturated mono-olefins; halogenized vinyls; vinyl esters; vinyl ethers; vinyl ketones; and nitrogen-containing vinyl compounds.

The releasing agent dispersion may include, but is not limited to a mixture of a paraffin-based wax and an ester-based wax; or an ester group-containing paraffin-based wax.

The coagulant may include, but is not limited to silicon (Si) and iron (Fe)-containing metallic salts.

The coagulant may include, but is not limited to polysilica iron.

According to another aspect of the disclosure, there is provided a method of forming images, the method including: attaching a toner to a surface of an image carrier on which an electrostatic latent image is formed to form a visualized image; and transferring the visualized image to a transfer medium, wherein the toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, the G'(60) and G'(80) are storage moduli Pa at about 60° C. and about 80° C. under measurement conditions of an angular velocity of about 6.28 rad/s and a heating rate of about 2.0° C./minute, respectively, and the G'(100, 140) is a storage modulus Pa at a temperature of about 100° C. to about 140° C. under measurement conditions of an angular velocity of about 6.28 rad/s and a heating rate of about 2.0° C./minute.

According to another aspect of the disclosure, there is provided a toner supplying unit including: a toner tank in which a toner is stored; a supplying part projecting inside the toner tank to supply the stored toner to the outside; and a toner agitating member rotatably disposed inside the toner tank to agitate the toner in almost an entire inner space of the toner tank including a location on a top surface of the supplying part, wherein the toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, the G'(60) and G'(80) are storage moduli Pa at about 60° C. and about 80° C. under measurement conditions of an angular velocity of about 6.28 rad/s and a heating rate of about 2.0° C./minute, respectively, and the G'(100, 140) is a storage modulus Pa at a temperature of about 100° C. to about 140° C. under measurement conditions of an angular velocity of about 6.28 rad/s and a heating rate of about 2.0° C./minute.

According to another aspect of the disclosure, there is provided an image forming apparatus including: an image carrier; an image forming unit forming an electrostatic latent image on a surface of the image carrier; a unit receiving toner; a toner supplying unit supplying the toner to the surface of the image carrier to develop the electrostatic latent image on the surface of the image carrier into a toner image; and a toner transfer unit transferring the toner image from the surface of the photoreceptor to a transferring medium, wherein the toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, the G'(60) and G'(80) are storage moduli Pa at about 60° C. and about 80° C. under measurement conditions of an angular velocity of about 6.28 rad/s and a heating rate of about 2.0° C./minute, respectively, and the G'(100, 140) is a storage modulus Pa at a temperature of about 100° C. to about 140° C. under measurement conditions of an angular velocity of about 6.28 rad/s and a heating rate of about 2.0° C./minute.

BRIEF DESCRIPTION OF THE DRAWINGS

Various features and advantages of the disclosure will become more apparent by describing in detail several embodiments thereof with reference to the attached drawings in which.

DETAILED DESCRIPTION OF SEVERAL EMBODIMENTS

Figure 1:
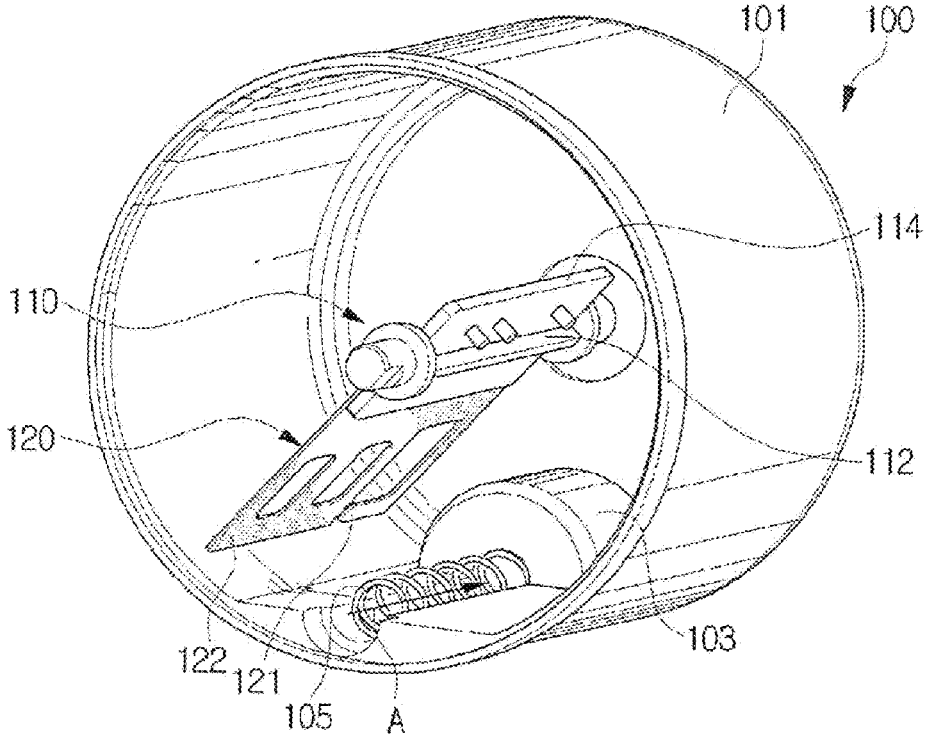
FIG. 1 is a view of a toner supplying apparatus according to an embodiment of the disclosure.

The disclosure will now be described more fully with reference to the accompanying drawings, in which several embodiments are shown.

Toner for developing an electrostatic latent image according to an embodiment may include a latex, a colorant and a releasing agent. The toner may have G'(60) of about $4.0\times10^7$ Pa to about $4.0\times10^8$ Pa, G'(60)/G'(80) of about 100 to about 500 and G'(100, 140) of about $3.0\times10^3$ Pa to about $1.5\times10^5$ Pa, where the G'(60) and G'(80) are each a storage modulus Pa of the toner at about 60° C. and about 80° C., respectively, and the G'(100, 140) is a storage modulus Pa of the toner at a temperature of about 100° C. to about 140° C.

Fusion-related properties such as a cold offset, a minimum fusing temperature (MFT), and a fusing latitude of the toner may be predicted from the observed values of the G'(60), the G'(60)/G'(80), and the G'(100, 140), respectively, where the values of the G'(60) and G'(80) may be achieved by respectively measuring storage moduli at about 60° C. and about 80° C. under measurement conditions of an angular velocity of about 6.28 rad/s and a heating rate of about 2.0° C./minute using a rheometer having two circular-shaped disks (for example, TA ARES model). Also, the value of the G'(100, 140) may be achieved by measuring a storage modulus Pa at a temperature of about 100° C. to about 140° C. under measurement conditions of an angular velocity of about 6.28 rad/s and a heating rate of about 2.0° C./minute.

Viscoelasticity of the toner may be affected by various factors such as thermal properties (a glass transition temperature ($T_g$), etc), cross-linkage, dispersion, miscibility, distribution, and used materials thereof. Specifically, viscoelasticity of the toner at the G'(60) and the G'(60)/G' (80), i.e., at temperatures less than about 100° C. may be affected by a latex, $T_g$ and a melting point ($T_m$) of a wax, types of coagulants, and a colorant. Also, viscoelasticity of the toner at the G'(100, 140), i.e., at temperatures greater than about 100° C., may be considerably affected by inner dispersion, average molecular weight, cross-linkage, and the particle size distribution thereof when compared to thermal properties of the latex or wax. Thus, the ranges of the G'(60), the G'(60)/G'(80), and the G'(100, 140) may all be determined according to characteristics of sources such as a latex, a colorant, a releasing agent and a coagulant used for preparing the toner and physical properties of the prepared toner.

The value of the G'(60) of the toner may be in the range of about $4.0\times10^7$ Pa to about $4.0\times10^8$ Pa. For example, the value of the G'(60) of the toner may be in the range of about $4.5\times10^7$ Pa to about $3.5\times10^8$ Pa or from about $5.0\times10^7$ Pa to about $3.0\times10^8$ Pa. If the value of the G'(60) is less than about $4.0\times10^7$ Pa, the toner may be easily deformed in a transfer process to cause a transfer error, or high temperature storage of the toner may be limited because the toner has low elasticity. Alternatively, if the value of the G'(60) is greater than about $4.0\times10^7$ Pa, it may be difficult to fuse toner images because the toner has high elasticity.

The value of the G'(60)/G'(80) of the toner may be in the range of about 100 to about 500. For example, the value of the G'(60)/G'(80) of the toner may be in the range of about 100 to about 450 or from about 150 to about 400. If the value of the G'(60)/G'(80) is less than about 100, a high temperature storability characteristic of the toner may deteriorate because the toner has low elasticity at about 60° C., or the toner may insufficiently melt because the toner has high elasticity at about 80° C. Alternatively, if the value of the G'(60)/G'(80) is greater than about 500, it may be difficult to obtain a stable image because the toner has very low elasticity at about 80° C.

The value of the G'(100, 140) of the toner may be in the range of about $3.0\times10^3$ Pa to about $1.5\times10^5$ Pa. For example, the value of the G'(100, 140) of the toner may be in the range of about $3.0\times10^3$ Pa to about $1.3\times10^5$ Pa or from about $3.5\times10^3$ Pa to about $1.2\times10^5$ Pa. If the value of the G'(100, 140) is less than about $3.0\times10^3$ Pa, it may be difficult to maintain high-quality image, e.g., uneven brightness may occur. Alternatively, if the value of the G'(100, 140) is greater than about $1.5\times10^5$ Pa, it may be difficult to obtain high gloss, or color reproduction may be poor.

The toner contains sulfur (S), iron (Fe), and silicon (Si). When S content, Fe content, and Si content according to a fluorescence X-ray analysis are referred to as the S content [S], the Fe content [Fe], and the Si content [Si], respectively, a ratio of [S]/[Fe] may be in the range of about $5.0\times10^{-4}$ to about $5.0\times10^{-2}$, and a ratio of [Si]/[Fe] may be in the range of about $5.0\times10^{-4}$ to about $5.0\times10^{-2}$.

A chain transfer agent, i.e., a S-containing compound is used to adjust the molecular weight distribution of the latex when the latex of the toner is prepared. The S content [S] is a value corresponding to the content of S contained in the chain transfer agent. Thus, if the S content [S] is relatively high, the average molecular weight of the latex may decrease, and a new chain may be initiated. If the S content [S] is relatively low, the chain may be continuously grown to increase the average molecular weight of the latex.

The Fe content [Fe] is a value corresponding to the content of Fe within a coagulant used for coagulating the latex, the colorant, and the releasing agent. Cohesion, the particle size distribution, and the size of an agglomerated toner corresponding to a precursor for preparing a final toner may be affected according to the Fe content [Fe].

The Si content [Si] is a value corresponding to the content of a silica particle used as an external additive to secure fluidity of polysilica contained in the coagulant and the toner. Thus, the factors affected by the Fe and the fluidity of the toner may be affected according to the Si content [Si].

The ratio of the [S]/[Fe], that is, a ratio of the S content [S] to the Fe content [Fe], may be in the range of about $5.0\times10^{-4}$ to about $5.0\times10^{-2}$. For example, the ratio of the [S]/[Fe] may be in the range of about $8.0\times10^{-4}$ to about $3.0\times10^{-2}$ or about $1.0\times10^{-3}$ to about $1.0\times10^{-2}$.

If the ratio of the [S]/[Fe] is less than about $5.0\times10^{-4}$, the average molecular weight of the toner may increase due to the very low S content [S], or the average molecular weight of the toner may affect the cohesion or badly affect the charge due to the high Fe content [Fe]. Alternatively, if the ratio of the [S]/[Fe] is greater than about $5.0\times10^{-2}$, the average molecular weight may decrease due to the very high S content [S], or the average molecular weight of the toner may affect the cohesion due to the low Fe content [Fe] to affect the particle size distribution or the size of the toner.

The ratio of the [Si]/[Fe], that is, a ratio of the Si content [Si] to the Fe content [Fe], may be in the range of about $5.0\times10^{-4}$ to about $5.0\times10^{-2}$. For example, the ratio of the [Si]/[Fe] may be in the range of about $8.0\times10^{-4}$ to about $3.0\times10^{-2}$ or about $1.0\times10^{-3}$ to about $1.0\times10^{-2}$.

If the ratio of the [Si]/[Fe] is less than about $5.0\times10^{-4}$, the fluidity of the toner may be reduced because the content of the silica particle used as the external additive is very low. Alternatively, if the ratio of the [Si]/[Fe] is greater than about $5.0\times10^{-2}$, the inside of a printer may be contaminated because the content of the silica particle used as the external additive is high.

A peak temperature of a maximal endothermic peak curve may be in the range of about 86° C. to about 95° C. on a differential scanning calorimeter (DSC) endothermic curve of the toner measured using the DSC. For example, the peak temperature may be in the range of about 86° C. to about 93° C. or from about 87° C. to about 92° C. If the peak temperature of the maximal endothermic peak curve is less than about 86° C., $T_g$ of the toner may decrease to deteriorate the high temperature storability of the toner. Alternatively, if the peak temperature of the maximal endothermic peak curve is greater than about 95° C., it may be difficult to adjust a configuration of the toner when the toner is prepared, and the fusibility of the toner may deteriorate due to increased $T_g$ of the toner.

According to an embodiment of the disclosure, a method of preparing the toner for developing the electrostatic latent image may include the following processes; mixing primary latex particles with a colorant dispersion and a releasing agent dispersion to prepare a mixture thereof; adding a coagulant to the mixture to prepare a primary agglomerated toner; and coating a secondary latex prepared by polymerizing one or more polymerizable monomers on the primary agglomerated toner to prepare a secondary agglomerated toner. The toner may have G'(60) of about $4.0\times10^7$ to about $4.0\times10^8$, G'(60)/G'(80) of about 100 to about 500, and G'(100, 140) of about $3.0\times10^3$ to about $1.5\times10^5$, where the G'(60) and G'(80) are each a storage modulus Pa at about 60° C. and about 80° C. under measurement conditions of an angular velocity of about 6.28 rad/s and a heating rate of about 2.0° C./minute, respectively. The G'(100, 140) is a storage modulus Pa at a temperature of about 100° C. to about 140° C. under measurement conditions of an angular velocity of about 6.28° rad/s and a heating rate of about 2.0° C./minute.

Examples of the coagulant may include, but are not limited to NaCl, $MgCl_2$, $MgCl_2.8H_2O$, $[Al_2(OH)_nCl_{6-n}]_m(Al_2(SO_4)_3.18H_2O$, poly aluminum chloride (PAC), poly aluminum sulfate (PAS), poly aluminum sulfate silicate (PASS), ferrous sulfate, ferric sulfate, ferric chloride, slaked lime, $CaCO_3$, and Si and Fe-containing metallic salt, but are not limited thereto.

The content of the coagulant, based on 100 parts by weight of the primary latex particles may be in the range of about 0.1 parts by weight to about 10 parts by weight. For example, the content of the coagulant may be in the range of about 0.5 parts by weight to about 8 parts by weight or from about 1 part by weight to about 6 parts by weight. If the content of the coagulant is less than about 0.1 parts by weight, coagulation efficiency may be reduced, and if the content of the coagulant is greater than 10 parts by weight, chargeability of the toner may be reduced, and the particle size distribution of the toner may deteriorate.

According to an embodiment of the disclosure, the toner for developing the electrostatic latent image uses the Si and Fe-containing metallic salt as the coagulant in a toner preparation method. The Si and Fe contents contained in the resultant toner may each be in the range of about 3 ppm to about 30,000 ppm, respectively. For example, the Si and Fe contents each may in be in the range of about 30 ppm to about 25,000 ppm or from about 300 ppm to about 20,000 ppm, respectively. If the Si and Fe contents are less than about 3 ppm, respectively, desired effects may not be obtained. Alternatively, if the Si and Fe contents are greater than about 30,000 ppm, respectively, limitations such as charge reduction may occur, and the inside of the printer may be contaminated.

The Si and Fe-containing metallic salt includes, for example, polysilicate-iron. Specifically, the Si and Fe-containing metallic salt is added to increase an ionic strength and collisions between particles during the toner preparation method according to the disclosure, thereby to increase the size of the primary agglomerated toner. An example of the Si and Fe-containing metallic salt is polysilica iron. Particularly, model Nos. PSI-025, PSI-050, PSI-085, PSI-100, PSI-200, and PSI-300 (products of Suido Kiko Co.), sold and available in the market, may be used. Properties and compositions of PSI-025, PSI-050, and PSI-085 are listed in Table 1 below.

TABLE 1

| | | Type | | | | | |
|---|---|---|---|---|---|---|---|
| | | PSI-025 | PSI-050 | PSI-085 | PSI-100 | PSI-200 | PSI-300 |
| Silica/Fe mole ratio (Si/Fe) | | 0.25 | 0.5 | 0.85 | 1 | 2 | 3 |
| Main component concentration | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or higher | | | | | |
| Average molecular weight | | 500,000 | | | | | |
| Appearance | | Yellowish brown transparent liquid | | | | | |

Since the Si and Fe-containing metallic salt is used as the coagulant in the toner preparation method, quench hardening may be possible, and a particle shape may be controllable.

A volume average particle diameter of the toner for developing the electrostatic latent image, according to an embodiment of the disclosure, may be in the range of about 3 μm to about 8 μm. For example, the volume average particle diameter of the toner may be in the range of about 4 μm to about 7.5 μm or from about 4.5 μm to about 7 μm. An average value of circularity may be in the range of about 0.940 to about 0.990. For example, the average value of the circularity may be in the range of about 0.945 to about 0.985 or from about 0.950 to 0.980.

In general, although it is more advantageous to obtain a high-resolution and a high-quality image as the toner particle decreases in size, it is disadvantageous in terms of a transfer speed and cleanability. Thus, it is important to adequately control the particle diameter.

The volume average particle diameter may be measured using an electrical Impedance method.

If the volume average particle diameter of the toner is less than 3 μm, limitations of cleaning a photoreceptor and a reduction in yield may occur. In addition, a bodily injury may be inflicted, on a person due to the scattering. Alternatively, if the volume average particle diameter of the toner is greater than 8 μm, it is difficult to obtain the high-resolution and the high-quality image, charging may not be uniformly performed, fusing properties of the toner may be decreased, and a Dr-Blade may not regulate a toner layer.

If the average value of circularity of the toner is less than about 0.94, an image developed on a transfer medium may have a high height, toner consumption may increase, and it may be difficult to obtain a sufficient coating rate of the image developed on the transfer medium due to a wide gap between the toner particles. Thus, to obtain a desired image concentration, a large amount of toner is required to increase the toner consumption. Alternatively, if the average value of circularity of the toner is greater than about 0.990, the toner may be excessively supplied onto a developing sleeve. As a result, the toner may be uniformly coated on the developing sleeve together therewith to contaminate.

The circularity of the toner may be measured using a flow particle image analyzer, for example, (FPIA)-3000 manufactured by SYSMEX CORPORATION, and may be calculated according to the following Equation.

$$\text{Circularity}=2\times(\pi\times\text{area})^{0.5}/\text{circumference} \qquad \text{Equation}$$

A value of the circularity is in the range of 0 to 1, with a value of 1 corresponding to a perfect circle.

A volume average particle size distribution index (GSDv) or a number average particle size distribution index (GSDp) that will be described below may be used as an index of the toner particle distribution. The GSDv and GSDp may be calculated as follows:

First, the particle size distribution of the toner measured using a measuring device such as, for example, a Multisizer III (manufactured by Beckman Coulter Inc.) that is a Coulter counter is drawn as an accumulated distribution from a small diameter side, for a divided particle size range (channel), regarding a volume and a number of individual toner particles. Next, a cumulative particle diameter of 16% is defined as a volume average particle diameter D16v and a number average particle diameter D16p, and a cumulative particle diameter of 50% is defined as a volume average particle diameter D50v and a number average particle diameter D50p. Similarly, a cumulative particle diameter of 84% is defined as a volume average particle diameter D84v and a number average particle diameter D84p.

Here, the GSDv is defined as $(D84v/D16v)^{0.5}$, and the GSDp is defined as $(D84p/D16p)^{0.5}$. The GSDv and GSDp may be calculated using these relational equations.

Values of the GSDv and GSDp may be about 1.30, or less respectively. For example, the values of the GSDv and GSDp may be in the range of about 1.15 to about 1.30 or from about 1.20 to about 1.25, respectively. If the values of the GSDv and GSDp are greater than 1.30, respectively, the particle diameters may be non-uniform.

In the above-described toner preparation method, the primary latex particles may include, but are not limited to a polyester alone; a polymer obtained by polymerizing one or more polymerizable monomers; or a mixture thereof (a hybrid type). When the polymer is used as the primary latex particles, the polymerizable monomers may be polymerized with a releasing agent such as a wax, or a releasing agent may be separately added to the polymer.

A primary latex having a particle size of less than about 1 μm, for example, in the range of about 100 nm to about 300 nm or form about 150 nm to about 250 nm may be prepared by emulsion polymerization.

Here, the polymerizable monomer may be at least one monomer selected from styrene-based monomers such as styrene, vinyl toluene and α-methyl styrene; acrylic acid or methacrylic acid; derivatives of (metha)acrylates such as methyl acrylate, ethyl acrylate, propyl acrylate, butyl acrylate, 2-ethylhexyl acrylate, dimethylamino ethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacryl amide; ethylenically unsaturated mono-olefins such as ethylene, propylene and butylenes; halogenized vinyls such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isoprophenyl ketone; and nitrogen-containing vinyl compounds such as 2-vinylpyridine, 4-vinylpyridine and N-vinyl pyrrolidone.

A polymerization initiator and a chain transfer agent may be used in a process of preparing the primary latex for the efficiency of the polymerization.

Examples of the polymerization initiator are persulfate salts such as potassium persulfate and ammonium persulfate; azo compounds such as 4,4-azobis(4-cyanovaleric acid), dimethyl-2,2'-azobis(2-methyl propionate), 2,2-azobis(2-amidinopropane)dihydrochloride, 2,2-azobis-2-methyl-N-1, 1-bis(hydroxymethyl)-2-hydroxyethylpropioamide, 2,2'-azobis(2,4-dimethyl valeronitrile), 2,2'-azobis isobutyronitrile and 1,1'-azobis(1-cyclohexanecarbonitrile); and peroxides such as methyl ethyl peroxide, di-t-butylperoxide, acetyl peroxide, dicumyl peroxide, lauroyl peroxide, benzoyl peroxide, t-butylperoxy-2-ethyl-hexanoate, di-isopropyl peroxydicarbonate and di-t-butylperoxy isophthalate. Also, an oxidization-reduction initiator in which the polymerization initiator and a reduction agent are combined may be used.

A chain transfer agent is a material to convert a type of chain carrier in a chain reaction. A new chain has much less activity than that of a previous chain. The polymerization degree of the monomer may be reduced and new chains may be initiated using the chain transfer agent. In addition, a molecular weight distribution of the toner may be adjusted using the chain transfer agent.

The content of the chain transfer agent may be in the range of about 0.1 parts by weight to about 5 parts by weight based on 100 parts by weight of one or more polymerizable monomers. For example, the content of the chain transfer agent may be in the range of about 0.2 parts by weight to about 3 parts by weight or from about 0.5 parts by weight to about 2.0 parts by weight. If the content of the chain transfer agent is less than about 0.1 parts by weight, coagulation efficiency may be reduced due to very high molecular weight. Alternatively, if the content of the chain transfer agent is greater than about 5 parts by weight, fusing performance may be reduced due to very low molecular weight.

Examples of the chain transfer agent may include, but are not limited to S-containing compounds such as dodecanthiol, thioglycolic acid, thioacetic acid and mercaptoethanol; phosphorous acid compounds such as phosphorous acid and sodium phosphite; hypophosphorous acid compounds such as hypophosphorous acid and sodium hypophosphite; and alcohols such as methyl alcohol, ethyl alcohol, isopropyl alcohol and n-butyl alcohol, but are not limited thereto.

The primary latex particles may further include a charge control agent. The charge control agent used herein may include, but is not limited to a negative charge type charge control agent or a positive charge type charge control agent. The negative charge type charge control agent may include an organic metal complex or a chelate compound such as an azo dye containing chromium or a mono azo metal complex; a salicylic acid compound containing metal such as chromium, iron and zinc; or an organic metal complex of an aromatic hydroxycarboxylic acid and an aromatic dicarboxylic acid. Moreover, any known charge control agent may be used without limitation. The positive charge type charge control agent may include a modified product such as nigrosine and a fatty acid metal salt thereof and an onium salt including a quaternary ammonium salt such as tributylammonium 1-hydroxy-4-naphthosulfonate and tetrabutylammonium tetrafluoro borate which may be used alone or in combination of at least two. Since the charge control agent stably supports the toner on a developing roller by electrostatic force, charging may be performed stably and quickly using the charge control agent.

The prepared primary latex may be mixed with a colorant dispersion and a releasing agent dispersion. The colorant dispersion may be prepared by homogeneously dispersing a composition including colorants such as black, cyan, magenta and yellow and an emulsifier using an ultrasonic homogenizer, micro fluidizer, or the like.

Carbon black or aniline black may be used as the colorant for a black toner, and for color toner, at least one of yellow, magenta and cyan colorants may be further included.

A condensation nitrogen compound, an isoindolinone compound, an anthraquine compound, an azo metal complex or an allyl imide compound may be used as the yellow colorant. In particular, C.I. colorant yellow 12, 13, 14, 17, 62, 74, 83, 93, 94, 95, 109, 110, 111, 128, 129, 147, 168, 180, or the like may be used.

A condensation nitrogen compound, an anthraquine compound, a quinacridone compound, a base dye lake compound, a naphthol compound, a benzo imidazole compound, a thioindigo compound or a perylene compound may be used as the magenta colorant. In particular, C.I. colorant red 2, 3, 5, 6, 7, 23, 48:2, 48:3, 48:4, 57:1, 81:1, 122, 144, 146, 166, 169, 177, 184, 185, 202, 206, 220, 221, 254, or the like may be used.

A copper phthalocyanine compound and derivatives thereof, an anthraquine compound, or a base dye lake compound may be used as the cyan colorant. In particular, C.I. colorant blue 1, 7, 15, 15:1, 15:2, 15:3, 15:4, 60, 62, 66, or the like may be used.

Such colorants may be used alone or in a combination of at least two colorants, and may be selected in consideration of color, chromacity, luminance, resistance to weather, dispersion capability in toner, etc.

As described above, the content of the colorant should be sufficient to color the toner. The content of the colorant may be in the range of about 0.5 parts by weight to about 15 parts by weight based on 100 parts by weight of the toner. For example, the content of the colorant may be in the range of about 1 part by weight to about 12 parts by weight or from about 2 parts by weight to about 10 parts by weight. If the content of the colorant is less than about 0.5 parts by weight based on 100 parts by weight of the toner, a sufficient coloring effect may not be obtained. Alternatively, if the content of the colorant is greater than 15 parts by weight, manufacturing costs of the toner may be increased, and a sufficient friction charge may not be obtained.

Any emulsifier that is known in the art may be used as an emulsifier used in the colorant dispersion. In this regard, an anionic reactive emulsifier, a nonionic reactive emulsifier or a mixture thereof may be used. For example, the anionic reactive emulsifier may include, but is not limited to HS-10 (Dai-ichi kogyo, Co., Ltd.), Dawfax 2A1 (Rhodia Inc.), etc., and the nonionic reactive emulsifier may include, but is not limited to RN-10 (Dai-ichi kogyo, Co., Ltd.).

The releasing agent dispersion used in the method for preparing the toner may include, but is not limited to a releasing agent, water, and an emulsifier.

Since the releasing agent may provide toner fused to a final image receptor at a low fusing temperature and having superior final image durability and an anti-abrasion property, the type and content of the releasing agent plays an important role in the determination of toner characteristics.

Examples of the releasing agent that may be used may include, but are not limited to polyethylene-based wax, polypropylene-based wax, Si wax, paraffin-based wax, ester-based wax, carnauba wax and metallocene wax, but are not limited thereto. The melting point of the releasing agent may be in the range of about 50° C. to about 150° C. Releasing agent components physically adhere to the toner particles, but do not covalently bond with the toner particles. Thus, the releasing agent may provide the toner, which is fused to the final image receptor at a low fusing temperature and has superior final image durability and an anti-abrasion property.

The content of the releasing agent may in the range of about 1 part by weight to about 20 parts by weight based on 100 parts by weight of the toner. For example, the content of the releasing agent may in the range of about 2 parts by weight to about 16 parts by weight or from about 3 parts by weight to about 12 parts by weight. If the content of the releasing agent is less than about 1 part by weight, low-temperature fusibility may be reduced, and a fusing temperature range may become narrower. Alternatively, if the content of the releasing agent is greater than about 20 parts by weight, storability and economical efficiency may be reduced.

A wax containing an ester group may be used as the releasing agent. An example of the wax may include, but is not limited to a mixture of an ester-based wax and a non-ester-based wax; or an ester group-containing wax containing an ester group in a non-ester-based wax.

This is done because the ester group has high affinity for the latex components of the toner. Thus, the wax may be uniformly distributed throughout the toner particles to effectively enhance wax effects. In addition, the non-ester-based wax components may inhibit excessive plasticization in case of the wax consisting of only the ester-based wax by a release effect with the latex. As a result, a good development of the toner may be maintained for a long time.

Examples of the ester-based wax may include, but are not limited to esters of fatty acids having 15-30 carbons, such as behenic acid behenyl ester, stearic acid stearyl ester, stearic acid of pentaerythritol, montanic acid glyceride ester, etc., and mono- through penta-alcohol. The alcohol component constituting the ester may have from 10 to 20 carbon atoms in case of the mono-alcohol. The alcohol component may have from 3 to 10 carbon atoms in case of the polyhydric alcohol.

The non-ester-based wax may include, but is not limited to a polyethylene-based wax and a paraffin-based wax.

An example of the wax including the ester group may include, but is not limited to a mixture of a paraffin-based wax and an ester-based wax; or an ester group-containing paraffin-based wax. Particularly, model names P-280, P-318, and P-319 (products of Chukyo yushi Co., Ltd) may be used as the wax.

When the releasing agent includes a mixture of a paraffin-based wax and an ester-based wax, the content of the ester-based wax of the releasing agent may be in the range of about 5% by weight to about 39% by weight based on the total weight of the releasing agent. For example, the content of the ester-based wax may be in the range of about 7% by weight to about 36% by weight or from about 9% by weight to about 33% by weight.

The content of the ester group of the releasing agent may be in the range of about 5% by weight to about 39% by weight based on the total weight of the releasing agent. For example, the content of the ester-based wax may be in the range of about 7% by weight to about 36% by weight or from about 9% by weight to about 33% by weight. If the content of the ester group is less than about 5% by weight, miscibility with the latex may be reduced. Alternatively, if the content of the ester group is greater than about 39% by weight, plasticization of the toner may be excessive, and thus, it may be difficult to maintain the development of the toner for a long time.

Any emulsifier that is known in the art may be used as an emulsifier used in the releasing agent dispersion, similar to the emulsifier used in the colorant dispersion. In this regard, an anionic reactive emulsifier, a nonionic reactive emulsifier or a mixture thereof may be used. For example, the anionic reactive emulsifier may include, but is not limited to HS-10 (Dai-ichi kogyo, Co., Ltd.), Dawfax 2A1 (Rhodia Inc.), etc., and the nonionic reactive emulsifier may include, but is not limited to RN-10 (Dai-ichi kogyo, Co., Ltd.).

The average molecular weight, $T_g$, and rheological properties of the primary latex particles formed in the core of the toner prepared according to the method described above may be adjusted to efficiently fuse toner particles at a low temperature.

The prepared primary latex particles, the colorant dispersion, and the releasing agent dispersion are mixed, and then a coagulant is added to the mixture to prepare an agglomerated toner. More particularly, when the primary latex particles, the colorant dispersion, and the releasing agent dispersion are mixed, the coagulant is added to the mixture at about pH 1 to about pH 4 to form a primary agglomerated toner having an average particle size of about 2.5 μm or less as a core. Then, a secondary latex is added to the resultant, and the pH is adjusted to about pH 6 to about pH 8. When the particle size is constantly maintained for a certain period of time, the resultant is heated to a temperature in a range of about 90° C. to about 96° C., and the pH is adjusted to about pH 5.8 to about pH 6 to prepare a secondary agglomerated toner.

One or more metallic salts selected from Si and Fe-containing metallic salts were be used as the coagulant. The Si and Fe-containing metallic salts may include, but are not limited to polysilica iron.

The secondary latex may be prepared by polymerizing one or more polymerizable monomers. The polymerizable monomers are emulsion polymerized to prepare latex having a particle size of about 1 μm or less. For example, the latex may have a particle size in a range of about 100 nm to about 300 nm. The secondary latex may also include a wax, and the wax may be added to the secondary latex in the polymerization process.

A tertiary latex prepared by polymerizing one or more polymerizable monomers may be coated on the secondary agglomerated toner.

By forming a shell layer with the secondary latex or the tertiary latex, durability may be improved, and the storability limitations of toner during shipping and handling may be overcome. Here, a polymerization inhibitor may be added in order to prevent new latex particles from being formed, or the reaction may be performed using a starved-feeding process to facilitate coating of the monomer mixture on the toner.

The prepared secondary agglomerated toner or tertiary agglomerated toner is filtered to separate toner particles and the toner particles are dried. The dried toner particles are subjected to an external additive addition process using an external additive, and the charge amount is controlled to prepare a final dry toner.

Silica, $TiO_2$, etc., may be used as the external additive. The content of the external additive may be in the range of about 1.5 parts by weight to about 7 parts by weight based on 100 parts by weight of non-additive toner. For example, the content of the external additive may be in the range of about 2 parts by weight to about 5 parts by weight. If the content of the external additive is less than about 1.5 parts by weight, a caking phenomenon, in which toners adhere to each other due to a cohesive power there between, may occur, and charging may not be uniformly performed. Alternatively, if the content of the external additive is greater than about 7 parts by weight, a roller may be contaminated by a large amount of an external additive.

The disclosure provides a method of forming images including attaching the toner to a surface of an image carrier on which an electrostatic latent image is formed to form a visualized image and transferring the visualized image to a transfer medium. The toner for developing an electrostatic latent image includes a latex, a colorant, and a releasing agent. The toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, where the G'(60) and G'(80) are each a storage modulus Pa of the toner at about 60° C. and about 80° C. under measurement conditions of an angular velocity of about 6.28 rad/s and a heating rate of about 2.0° C./minute, respectively. The G'(100, 140) is a storage modulus Pa of the toner at a temperature of about 100° C. to about 140° C. under measurement conditions of an angular velocity of about 6.28 rad/s and a heating rate of about 2.0° C./minute.

A representative electrophotographic image forming process includes a series of processes of forming images on a receptor, the processes including charging, exposure to light, developing, transferring, fusing, cleaning and erasing.

In the charging process, a surface of an image carrier is charged with negative or positive charges, as desired, by a corona or a charge roller. In the light exposing process, an optical system, conventionally a laser scanner or an array of diodes, selectively discharges the charged surface of the image carrier in an imagewise manner corresponding to a final visual image formed on a final image receptor to form a latent image. The optical system uses electromagnetic radiation, also referred to as "light", which may be infrared light irradiation, visible light irradiation, or ultra-violet light irradiation.

In the developing process, suitably charged toner particles generally contact the latent image of the image carrier, and conventionally, an electrically-biased developer having identical potential polarity to the toner polarity is used. The toner particles move to the image carrier and are selectively attached to the latent image by electrostatic force to form a toner image on the image carrier.

In the transferring process, the toner image is transferred to the final image receptor from the image carrier, and sometimes, an intermediate transferring element is used to facilitate transferring the toner image from the image carrier to the final image receptor.

In the fusing process, the toner image of the final image receptor is heated, and the toner particles thereof are softened or melted, thereby fusing the toner image to the final image receptor. Another way of fusing is to fuse toner on the final image receptor under high pressure with or without the application of heat.

In the cleaning process, residual toner remaining on the image carrier is removed.

Finally, in the erasing process, charges of the image carrier are exposed to light of a predetermined wavelength band and are reduced to be substantially uniform and of low value, and thus the residue of the latent image is removed and the photoreceptor is prepared for a next image forming cycle.

According to aspects of the present disclosure, a toner supplying unit may be provided to include a toner tank in which toner is stored; a supplying part projecting inside the toner tank to supply the stored toner to the outside; and a toner agitating member rotatably disposed inside the toner tank to agitate the toner in almost an entire inner space of the toner tank including a location on a top surface of the supplying part. The toner for developing an electrostatic latent image may include a latex, a colorant and a releasing agent. The toner has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, where the G'(60) and G'(80) are each a storage modulus Pa of the toner at about 60° C. and about 80° C. under measurement conditions of an angular velocity of about 6.28 rad/s and a heating rate of about 2.0° C./minute, respectively. The G'(100, 140) is a storage modulus Pa of the toner at a temperature of about 100° C. to about 140° C. under measurement conditions of an angular velocity of about 6.28 rad/s and a heating rate of about 2.0° C./minute.

FIG. 1 is a view of a toner supplying apparatus 100 according to an embodiment of the disclosure.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape.

The supplying part 103 is disposed at a bottom of the inside of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. The supplying part 103 includes a toner outlet (not shown) to discharge the toner to an outer surface thereof.

The toner-conveying member 105 is disposed at a side of the supplying part 103 at the bottom of the inside of the toner tank 101. The toner-conveying member 105 may be formed in, for example, a coil spring shape. An end of the toner-conveying member 105 extends in an inside the supplying part 103 so that when the toner-conveying member 105 rotates, the toner in the toner tank 101 is conveyed to the inside of the supplying part 103. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. For example, when the toner-agitating member 110 rotates at a middle of the toner tank 101, the toner in the toner tank 101 is agitated to prevent the toner from solidifying. As a result, the toner moves down to the bottom of the toner tank 101 by its own weight. The toner-agitating member 110 includes a rotation shaft 112 and a toner agitating film 120. The rotation shaft 112 is rotatably disposed at the middle of the toner tank 101 and has a driving gear (not shown) coaxially coupled with an end of the rotation shaft 112 projecting from a side of the toner tank 101. Therefore, the rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetric about the rotation shaft 112. The toner agitating film 120 has a width corresponding to the inner length of the toner tank 101. Furthermore, the toner agitating film 120 may be elastically deformable. For example, the toner agitating film 120 may bend toward or away from a projection inside the toner tank 101, i.e., the supplying part 103.

Portions of the toner agitating film 120 may be cut off from the toner agitating film 120 toward the rotation shaft 112 to form a first agitating part 121 and a second agitating part 122.

According to aspects of the present disclosure, an image forming apparatus may be provided to include an image carrier; an image forming unit forming a latent image on a surface of the image carrier; a unit receiving toner; a toner supplying unit supplying the toner to the surface of the image carrier to develop the latent image formed on the surface of the image carrier so as to develop a toner image; and a toner transfer unit transferring the toner image from the surface of the image carrier to a transferring medium.

The toner for developing an electrostatic latent image has G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^8$ Pa, where the G'(60) and G'(80) are each a storage modulus Pa of the toner at about 60° C. and about 80° C. under measurement conditions of an angular velocity of about 6.28 rad/s and a heating rate of about 2.0° C./minute, respectively. The G'(100, 140) is a storage modulus Pa of the toner at a temperature of about 100° C. to about 140° C. under measurement conditions of an angular velocity of about 6.28 rad/s and a heating rate of about 2.0° C./minute.

Figure 2:
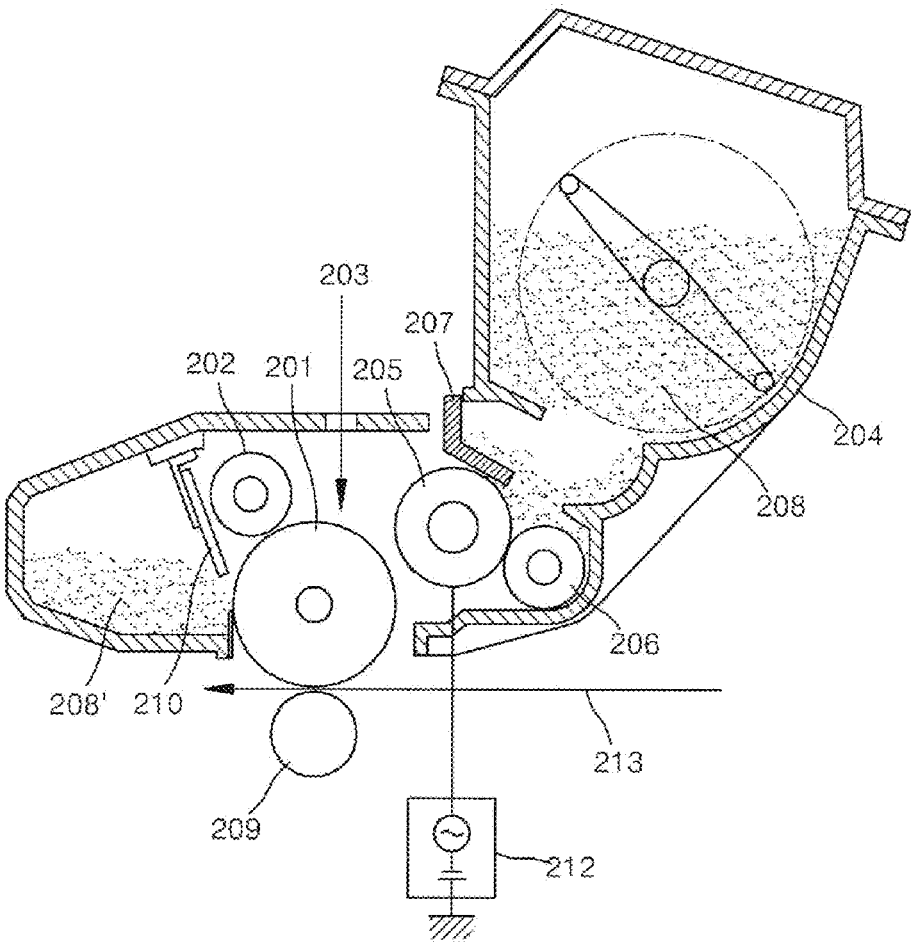
FIG. 2 is a view of an image forming apparatus including toner prepared according to an embodiment of the disclosure.

FIG. 2 is a view of a non-contact development type imaging apparatus including toner prepared using a method according to an embodiment of the disclosure.

A developer 208 which includes a nonmagnetic one-component of a developing device 204 is supplied to a developing roller 2055 by a supply roller 206 formed of an elastic material, such as a polyurethane foam or sponge. The developer 208 supplied to the developing roller 205 reaches a contact portion between a developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 is controlled and formed into a thin layer which has a uniform thickness and is sufficiently charged. The developer 208 which has been formed into a thin layer is transferred to a development region of a photoreceptor 201 that is an image carrier, in which a latent image is developed by the developing roller 205. At this time, the latent image is formed by scanning light 203 to the photoreceptor 201.

The developing roller 205 is separated from the photoreceptor 201 by a predetermined distance and faces the photoreceptor 201. The developing roller 205 rotates in a counterclockwise direction, and the photoreceptor 201 rotates n clockwise direction.

The developer 208 which has been transferred to the development region of the photoreceptor 201 develops the latent image formed on the photoreceptor 201 by an electric force generated by a potential difference between a direct current (DC) biased alternating current (AC) voltage applied to the developing roller 205 and a latent potential of the photoreceptor 201 charged by a charging unit 202 so as to form a toner image.

The developer 208, which has been transferred to the photoreceptor 201, reaches a transfer unit 209 due to the rotation direction of the photoreceptor 201. The developer 208, which has been transferred to the photoreceptor 201, is transferred to a print medium 213 to form an image by the transfer unit 209 having a roller shape and to which a high voltage having a polarity opposite to the developer 208 is applied, or by corona discharging when the print medium 213 passes between the photoreceptor 201 and the transfer unit 209.

The image transferred to the print medium 213 passes through a high temperature and high pressure fusing device (not shown) and thus the developer 208 is fused to the print medium 213 to form the image. Meanwhile, a non-developed, residual developer 208' on the developing roller 205 is collected by the supply roller 206 to contact the developing roller 205, and the non-developed, residual developer 208' on the photoreceptor 201 is collected by a cleaning blade 210. The processes described above are repeated.

Various embodiments of the disclosure will be described in further detail with reference to the following examples. However, the disclosure is not limited thereto.

A configuration of the toner manufactured by the following method was confirmed using scanning electron microscopy (SEM) pictures, and the circularity of the toner may be measured using an FPIA-3000 manufactured by SYSMEX CORPORATION and calculated according to the following Equation.

$$\text{Circularity}=2\times(\pi\times\text{area})^{0.5}/\text{circumference} \qquad \text{Equation}$$

A value of the circularity is in the range of 0 to 1, with a value of 1 corresponding to a perfect circle.

Example 1

Synthesis of Primary Latex 1,000 g of a polymerizable monomer mixture (the weight ratio of styrene/n-butyl acrylate is 75.3/24.7), 33 g of b-carboxyethyl acrylate (Sipomer, Rhodia), 4.2 g of A-decanediol diacrylate as a cross-linking agent, 7.5 g of 1-dodecanethiol as a chain transfer agent (CTA), and 500 g of a sodium dodecyl sulfate (Aldrich) aqueous solution (2% in water) as an emulsifier were added to a 3 L beaker and then agitated so as to prepare a polymerizable monomer emulsion. The prepared polymerizable monomer emulsion was dropped and also slowly added for 2 hours or more while 18 g of ammonium persulfate (APS) as an initiator and 1,160 g of a sodium dodecylsulfate (Aldrich) aqueous solution (0.13% in water) as an emulsifier were added to a 3 L double jacketed reactor heated at a temperature of about 75° C. and then agitated. The mixture was reacted at a reaction temperature for 8 hours. The particle size of the prepared latex was measured by a light scattering apparatus (Horiba 910) and was in the range from about 150 nm to about 200 nm. At this time, a concentration thereof was about 42.3%.

Preparation of Colorant Dispersion 10 g of a mixture of an anionic reactive emulsifier (HS-10; DAI-ICH KOGYO) and 60 g of a cyan colorant were added to a milling bath, and then 400 g of glass beads each having a diameter of about 0.8 mm to about 1 mm was added to mill the mixture at room temperature, thereby to prepare a dispersion using an ultrasonic homogenizer (Sonic and materials, VCX750).

Agglomeration and Preparation of Toner 500 g of deionized water, 150 g of the primary latex for a core, 35 g of the cyan colorant dispersion (HS-10 100%), and 28 g of a 35% wax dispersion P-419 (Chukyo yushi Co., Ltd) (a paraffin wax content having the range of about 20% to about 30%, an ester wax content having the range of about 10% to about 20%, and a melting point of about 90.8° C.) were added to a 1 L reactor to prepare a mixture. Then, 15 g of nitric acid (0.3 mol) and 15 g of 16% PSI-025 (sold by Suido Kiko Co.) as a coagulant were further added to the mixture to agitate the resultant mixture at 11,000 rpm for 6 minutes using a homogenizer, thereby to obtain a primary agglomerated toner having a volume average diameter of about 1.5 μm to about 2.5 μm. The resultant mixture was added to a 1 L double jacketed reactor, and heated from room temperature to about 50° C. (greater than $T_g$−5° C. of the latex) at a rate of 0.02° C. per minute. When the volume average diameter of the primary agglomerated toner reaches to about 6.3 μm, 50 g of a secondary latex prepared by polymerizing polystyrene-based polymerizable monomers was added thereto. When the volume average diameter is in range of about 6.5 μm to about 7.0 μm, NaOH (1 mol) was added thereto to adjust the pH to 7. When the value of the volume average diameter was constantly maintained for 10 minutes, the temperature was increased to 96° C. (at a rate of 0.5° C./min). When the temperature reached 96° C., nitric acid (0.3 mol) was added thereto to adjust the pH to 5.7. Then, the resultant was agglomerated for 3-5 hours to obtain a secondary agglomerated toner having a volume average diameter of about 6.5 μm to about 7 μm in a potato-shape. Then, the secondary agglomerated toner was cooled to a temperature lower than $T_g$, and the toner particles were separated through a separation process, and dried.

The dried toner particles were subjected to an external adding process by adding 0.5 parts by weight of NX-90 (Nippon Aerosil), 1.0 parts by weight of RX-200 (Nippon Aerosil), and 0.5 parts by weight of SW-100 (Titan Kogyo) to 100 parts by weight of the dried toner particles, and agitating the mixture in a mixer (KM-LS2K, Dae Wha Tech) at 8,000 rpm for 4 minutes. Toner having a volume average diameter of about 6.5 μm to 7.0 μm was obtained. GSDp and GSDv of the toner were 1.282 and 1.217, respectively. Also, an average circularity of the toner was 0.971.

Example 2

Toner was prepared in a same manner as in Example 1, except that P-420 (Chukyo yushi Co., Ltd) (a paraffin wax content having the range of about 25% to about 35%, an ester wax content having the range of about 5% to about 10%, and a melting point of about 91.8° C.) was used as a wax dispersion. GSDp and GSDv of the toner were 1.268 and 1.223, respectively. Also, an average circularity of the toner was 0.972.

Example 3

Toner was prepared in the same manner as in Example 1, except that sasolwax C80 (SASOL WAX) (a paraffin wax and a melting point of about 88° C.) was used as a wax. GSDp and GSDv of the toner were 1.261 and 1.238, respectively. Also, an average circularity of the toner was 0.970.

Comparative Example 1

Toner was prepared in a same manner as in Example 1, except that P-212 (Chukyo yushi Co., Ltd) (a paraffin wax content having the range of about 25% to about 35%, an ester wax content having the range of about 5% to about 10%, and a melting point of about 82° C.) was used as a wax dispersion. GSDp and GSDv of the toner were 1.265 and 1.244, respectively. Also, an average circularity of the toner was 0.973.

Comparative Example 2

Toner was prepared in the same manner as in Example 1, except that polyaluminum chloride (PAC) was used as a coagulant. GSDp and GSDv of the toner were 1.263 and 1.219, respectively. Also, an average circularity of the toner was 0.969.

Comparative Example 3

Toner was prepared in the same manner as in Example 1, except that HNP-100 (Nippon Seiro Co., Ltd.) (paraffin wax and a melting point of about 91° C.) was used as a wax. GSDp and GSDv of the toner were 1:267 and 1.220, respectively. Also, an average circularity of the toner was 0.969.

Comparative Example 4

Toner was prepared in the same manner as in Example 1, except that HNP-9 (Nippon Seiro Co., Ltd.) (paraffin wax and a melting point of about 75° C.) was used as a wax. GSDp and GSDv of the toner were 1.270 and 1.228, respectively. Also, an average circularity of the toner was 0.973.

Method of Evaluating Toner

Fusing Property Evaluation

Equipment: Belt-type fusing device (Fusing device—manufacturer: SAMSUNG ELECTRONICS CO. LTD., Product name: color laser 660 model)

Non-fused image for test: 100% pattern test temperature: 100~200° C. (10° C. intervals)

fusing speed: 160 mm/sec fusing time: 0.08 sec

After a test is performed under the above-mentioned conditions, fusibility of the fused image was evaluated according to following criteria.

After an outer diameter (OD) of the fused image is measured, a 3M 810 tape is attached to an image portion, and then a 500 g weight is reciprocated five times to remove the tape. After the tape is removed, the OD is measured.

Fusibility (%)=(after peeling off the OD_tape/before peeling off the OD_tape)×100

A fusing temperature region having fusibility greater than about 90% is regarded as a fusing region of toner.

MFT: Minimum Fusing Temperature [a minimum temperature having fusibility of greater than about 90% without causing Cold-offset]

HOT: Hot Offset Temperature [a minimum temperature at which Hot-offset occurs]

Fluorescence X-Ray Measurement

A fluorescence X-ray measurement used an energy dispersive X-ray spectrometer (EDX-720, SHIMADZU Corp.). A X-ray tube voltage was about 50 kV, and a sample formation amount was 3 g±0.01 g. The S content [S]/the Fe content [Fe] and the Si content [Si]/the Fe content [Fe] of each of samples were calculated using an intensity value (cps/uA) from quantitative results achieved by the fluorescence X-ray measurement.

Glossiness Evaluation

Glossiness was measured at a temperature of about 160° C., which is an operational temperature of the fusing device using a glossmeter (manufacturer: BYK Gardner, Product name: micro-TRI-gloss) that is a device for measuring glossiness.

Measurement angle: about 60°

Measurement pattern: 100% pattern

High-Temperature Conservation Evaluation

After 100 g of the toner is externally added, the externally added toner was introduced into a developing device (manufacturer: SAMSUNG ELECTRONICS CO. LTD., Product name: color laser 660 model) to store the toner in a constant-temperature and constant-humidity oven in a packaged state under the following conditions.

23° C., RH (Relative Humidity) of 55% for 2 hours

⇒40° C., RH of 90% for 48 hours

⇒50° C., RH of 80% for 48 hours

⇒40° C., RH of 90% for 48 hours

⇒23° C., RH of 55% for 6 hours

After the toner is stored under the above-stated conditions, it is determined whether a caking phenomenon occurs at the toner within the developing device with the naked eye and an image is completely outputted to evaluate image defect.

Reference of Evaluation

○: Good image, No-caking

Δ: Poor image, No-caking

X: Caking occurrence

Evaluation of Toner Fluidity (Carr's Cohesion)

Equipment: Hosokawa micron powder tester PT-S

Sample volume: 2 g (external additive toner or non-additive toner)

Amplitude: 1 mm_dial 3~3.5

Sieve: 53, 45, and 38 μm

Vibration time: 120 seconds

After the sample is stored at a temperature of about 23° C. and RH of 55% for 2 hours, the sieve for each size is measured before and after the changes under the above-stated conditions to calculate cohesion of toner using the following Equation.

[(a mass of powder remaining on the sieve having the largest size)/2 g]×100 (1)

[(a mass of powder remaining on the sieve having a middle size)/2 g]×100 (2)

[(a mass of powder remaining on the sieve having the smallest size)/2 g]×100×(⅓) (3)

Carr's Cohesion=(1)+(2)+(3)

Reference of Fluidity Evaluation

◎: Vastly superior fluidity as having Carr's cohesion of less than about 10%

○: Satisfactory fluidity as having Carr's cohesion of about 10% to about 20%

Δ: Inferior fluidity as having Carr's cohesion of about 20% to about 40%

X: Vastly inferior fluidity as having Carr's cohesion greater than about 40%

Evaluation of Charging Property of Toner 28.5 g of a carrier and 1.5 g of toner are added to a 60 ml glass container and the mixture is agitated using a turbula mixer, and then, the amount of charge of the toner is measured using an electric-field separation method.

Charge stability of the toner according to an agitation time under constant-temperature and constant-humidity conditions and a charge ratio of high-temperature and high-humidity/low-temperature and low-humidity are utilized as a measure of the evaluation.

Constant-temperature and constant-humidity: 23° C., RH of 55%

High-temperature and high-humidity: 32° C., RH of 80%

Low-temperature and low-humidity: 10° C., RH of 10%

Charge Stability

○: A charge saturation curve according to the agitation time is smooth, and after the saturation charge is reached, a width change is very small.

Δ: A charge saturation curve according to the agitation time is shifted slightly, and after the saturation charge is reached, a width change is somewhat small (maximum 30%).

X: A charge according to the agitation time is not saturated, or after the saturation charge is reached, a width change is very large (greater than 30%).

Ratio of HH/LL

○: 0.55 or more

Δ: 0.45~0.55

X: Less than 0.45

Maximal Endothermic Peak Temperature Measurement

A maximal peak temperature on a differential scanning calorimeter (DSC) endothermic curve measured by a DSC was measured as a maximal endothermic peak temperature of the toner.

TABLE 2

| | Wax | G' (60) | G' (80) | G'(60)/ G'(80) | G'(100, 140) Maximum | G'(100, 140) Minimum | [Si]/[Fe] | [S]/[Fe] |
|---|---|---|---|---|---|---|---|---|
| Example 1 | P-419 | $2.19 \times 10^8$ | $7.57 \times 10^5$ | 290 | $4.02 \times 10^3$ | $8.64 \times 10^4$ | 0.0034 | 0.0019 |
| Example 2 | P-420 | $2.14 \times 10^8$ | $8.92 \times 10^5$ | 240 | $4.52 \times 10^3$ | $1.05 \times 10^5$ | 0.0041 | 0.0023 |
| Example 3 | C80 | $4.32 \times 10^7$ | $3.77 \times 10^5$ | 114.6 | $3.96 \times 10^3$ | $1.02 \times 10^5$ | 0.035 | 0.021 |
| Comparative example 1 | P-212 | $3.05 \times 10^7$ | $2.76 \times 10^5$ | 110.5 | $3.52 \times 10^3$ | $3.91 \times 10^4$ | 0.0042 | 0.0025 |
| Comparative example 2 | P-420 | $2.23 \times 10^8$ | $9.09 \times 10^5$ | 245 | $4.63 \times 10^3$ | $1.90 \times 10^5$ | — | — |
| Comparative example 3 | HNP-100 | $2.09 \times 10^8$ | $9.10 \times 10^5$ | 230 | $4.98 \times 10^3$ | $2.32 \times 10^5$ | 0.0036 | 0.0020 |
| Comparative example 4 | HNP-9 | $3.00 \times 10^7$ | $4.05 \times 10^5$ | 74.1 | $3.60 \times 10^3$ | $4.05 \times 10^4$ | 0.033 | 0.019 |

| | Maximal endothermic peak temperature | Glossiness | Fusing property MFT | Fusing property HOT | Charge | Charge HH/LL | Charge | fluidity | High-temperature conservation |
|---|---|---|---|---|---|---|---|---|---|
| Example 1 | 88.1 | 8.8 | 150° C. | 210° C. | ○ | 0.63 | ○ | ○ | ◎ |
| Example 2 | 89.0 | 8.8 | 150° C. | 210° C. | ○ | 0.62 | ○ | ○ | ◎ |
| Example 3 | 87.8 | 9.0 | 140° C. | 200° C. | ○ | 0.69 | ○ | ○ | ◎ |
| Comparative example 1 | 80.4 | 8.9 | 130° C. | 200° C. | Δ | 0.41 | X | Δ | X |
| Comparative example 2 | 89.2 | 7.2 | 170° C. | 210° C. | ○ | 0.59 | ○ | ○ | ◎ |
| Comparative example 3 | 90.8 | 5.8 | 180° C. | 210° C. | Δ | 0.48 | Δ | ○ | ○ |
| Comparative example 4 | 76.0 | 8.9 | 130° C. | 200° C. | ○ | 0.65 | ○ | ○ | X |

Referring to Table 2, in case of the examples 1 through 3 that satisfy the ranges of G'(60) of about $4.0\times10^7$ Pa to about $4.0\times10^8$ Pa, G'(60)/G'(80) of about 100 to about 500, and G'(100, 140) of about $3.0\times10^3$ Pa to about $1.5\times10^5$ Pa, it can be seen that all of the glossiness, the fusing property, the charge property, the fluidity, and the high-temperature conservation are very superior.

Also, it can be seen that the high-temperature conservation is reduced in Comparative Examples 1 and 4 in which each value of G'(60), i.e., each storage modulus Pa, has a range less than the above-stated ranges, and the glossiness and the fusing property are reduced in Comparative Examples 2 and 3 in which a maximal value of G'(100, 140) has a range greater than the above-stated ranges.

While aspects of the disclosure has been particularly shown and described with reference to several embodiments thereof, it will be understood by those of ordinary skill in the art that various changes in form and details may be made therein without departing from the spirit and scope of the disclosure as defined by the following claims.

What is claimed is:

1. A toner for developing an electrostatic latent image comprising a latex, a colorant, a releasing agent, sulfur (S), iron (Fe) and silicon (Si), wherein the toner has G'(60) of about $4.0\times10^7$ Pa to about $4.0\times10^8$ Pa, G'(60)/G'(80) of about 100 to about 500 and G'(100, 140) of about $3.0\times10^3$ Pa to about $1.5\times10^5$ Pa, wherein the G'(60) and G'(80) are storage moduli Pa at 60° C. and 80° C. under measurement conditions of an angular velocity of about 6.28 rad/s and a heating rate of 2.0° C./minute, respectively, wherein the G' (100, 140) is a storage modulus Pa at a temperature of 100° C. to 140° C. under measurement conditions of an angular velocity of about 6.28 rad/s and a heating rate of 2.0° C./minute, and wherein when S content, Fe content and Si content according to a fluorescence X-ray, analysis are referred to as [S], [Fe] and [Si], respectively, a ratio of [S]/[Fe] is in the range of $5.0\times10^{-4}$ to $5.0\times10^{-2}$, and a ratio of [Si]/[Fe] is in the range of $5.0\times10^{-4}$ to $5.0\times10^{-2}$.

2. The toner of claim 1, further comprising silicon (Si) and iron (Fe) each in the range of 3 ppm of the toner to 30,000 ppm of the toner.

3. The toner of claim 1, wherein the releasing agent comprises a mixture of a paraffin-based wax and an ester-based wax; or an ester group-containing paraffin-based wax.

4. The toner of claim 3, wherein the ester-based wax of the releasing agent is in the range of 5% by weight to 39% by weight based on the total weight of the releasing agent.

5. The toner of claim 1, wherein a peak temperature of a maximal endothermic peak curve is in the range of 86° C. to 95° C. on a differential scanning calorimeter (DSC) endothermic curve of the toner measured using a DSC.

6. The toner of claim 1, wherein a volume average particle diameter of the toner is in the range of 3 μm to 8 μm.

7. The toner, of claim 1, wherein an average value of circularity of the toner is in the range of 0.940 to 0.990.

8. The toner of claim 1, wherein values of a volume average particle size distribution index (GSDv) and a number average particle size distribution index (GSDp) of the toner are 1.30 or less.

* * * * *